US007600750B2

(12) United States Patent
Kanazawa

(10) Patent No.: US 7,600,750 B2
(45) Date of Patent: Oct. 13, 2009

(54) PAPER SHEET CARRYING APPARATUS HAVING LINKING DEVICE WITH DROP ROD APPARATUS

(75) Inventor: Masato Kanazawa, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 19 days.

(21) Appl. No.: 11/959,590

(22) Filed: Dec. 19, 2007

(65) Prior Publication Data

US 2008/0157463 A1 Jul. 3, 2008

(30) Foreign Application Priority Data

Dec. 28, 2006 (JP) ..... 2006-354583

(51) Int. Cl.
*B65H 29/38* (2006.01)

(52) U.S. Cl. ..... 271/177

(58) Field of Classification Search ..... 271/177, 271/180

See application file for complete search history.

(56) References Cited

U.S. PATENT DOCUMENTS 4,231,291 A * 11/1980 Davidson, Jr. ..... 101/137

FOREIGN PATENT DOCUMENTS

JP 61-055054 3/1986
JP 01060557 A * 3/1989
JP 06-040600 2/1994
JP 09-114156 5/1997
JP 11-059969 3/1999
JP 2001278503 A * 10/2001

* cited by examiner

*Primary Examiner*—Patrick H MacKey
*Assistant Examiner*—Gerald W McClain
(74) *Attorney, Agent, or Firm*—Renner, Otto, Boisselle & Sklar, LLP

(57) ABSTRACT

A paper sheet carrying apparatus is provided that can remove a sheet remained in a path due to paper jam, etc. using a simple mechanism if a sheet remains in any one of two sheet paths or straddles both paths. A sheet path of a first unit is linked to that of a second unit by a linking device and a control mechanism is included that sends to the device and discharges a sheet stopped carrying from the path of the first unit to that of the second unit. When a sheet exists in the path of the second unit, it is carried in opposite direction to the linking device. When a sheet straddles both paths of the first and second units, it is carried to the linking device concurrently in forward direction in the path of the first unit and in opposite in that of the second unit.

7 Claims, 17 Drawing Sheets

FIG. 9

| STATE | FIRST SENSOR (15) | SECOND SENSOR (44) | THIRD SENSOR (45) | FOURTH SENSOR (34) | CORRESPONDING FIGURE |
|---|---|---|---|---|---|
| (1) | ○ | × | × | × | FIG. 2A |
| (1) | ○ | ○ | × | × | FIG. 2A |
| (3) | ○ | ○ | ○ | × | FIG. 5A |
| (3) | ○ | ○ | ○ | ○ | FIGS. 4A AND 7A |
| (3) | × | ○ | ○ | ○ | FIG. 6A |
| (2) | × | × | ○ | ○ | FIG. 3A |
| (2) | × | × | × | ○ | FIG. 3A |

PAPER SHEET CARRYING APPARATUS HAVING LINKING DEVICE WITH DROP ROD APPARATUS

CROSS-NOTING PARAGRAPH

This Non-provisional application claims priority under 35 U.S.C. §119 (a) on Patent Application No. 2006-354583 filed in JAPAN on Dec. 28, 2006, the entire contents of which are hereby incorporated herein by reference.

FIELD OF THE INVENTION

The present invention relates to a paper sheet carrying apparatus that carries paper sheets from one unit to the other unit.

BACKGROUND OF THE INVENTION

Recently, the print speed is increased in image forming apparatuses widely used as printers and copiers and, for example, the number of printed sheets for standard A4 type is 100 to 120 sheets/min, which was 40 to 60 sheets/min some years ago. As the print speed is increased, sheet carriage intervals are shortened, and the number of sheets concurrently carried to a sheet path is increased. On the other hand, if sheets are jammed in the sheet path while an apparatus is operated, all the sheets remaining in the sheet path must be removed to restore the apparatus to the operable state after the drive of the sheet path is suspended.

However, if the print speed is increased as above, the number of sheets staying and remaining in the sheet path is also increased when the sheets are jammed, and a heavy burden is imposed due to the effort to remove these sheets. Therefore, although many propositions have been made to facilitate the removal of sheets remaining in the sheet path of the apparatus, a method is generally used to remove the sheets manually using several opening/closing means disposed in some portions of the sheet path of the apparatus.

In the disclosure of Japanese Laid-Open Patent Publication No. 61-055054, when jamming occurs in a carriage path after toner is transferred in an electrophotography apparatus, a non-fixed recording paper sheet is discharged as a fixed recording paper sheet to prevent toner from scattering and contaminating hands and clothes of an operator or the apparatus main body and the periphery of the apparatus at the time of removing the jammed paper sheets.

In the disclosure of Japanese Laid-Open Patent Publication No. 9-114156, a sheet path is driven by a plurality of drive systems, and jammed sheets are manually removed after stopping the drive system, on the other hand, sheets not jammed are returned to a paper feed tray or discharged to an emergency paper discharge tray by separately driving each of the drive systems.

In the disclosure of Japanese Laid-Open Patent Publication No. 11-059969, when a paper-leaf-shaped medium (such as paper money and security sheet) is carried from a first carriage path to a second carriage path, if a paper jam occurs on the way, the carriage direction of the second carriage path is switched to the opposite direction to collect the jammed sheet in a predetermined stacker.

In accordance with Japanese Laid-Open Patent Publication Nos. 9-114156 and 11-059969, when a jam occurs while carrying a sheet, the sheet in the carriage path can be carried in the opposite direction and automatically removed, and the removal of jammed paper by hand can be alleviated. However, when a sheet is carried from a carriage path of one unit to a carriage path of the other unit (i.e., when a sheet is carried from one of two carriage paths to the other carriage path), the carriage direction for removing the sheet varies depending on whether the sheet exist in which carriage path of the two carriage paths, and the detection of the sheet and the control mechanism become complicated.

When the jam occurs, one sheet may straddle two carriage paths (two units). In this case, it is difficult to control which direction one sheet should be carried for removal. When two carriage paths can be separated from each other, if the apparatus is opened, the sheet straddling two carriage paths may be guillotined and damaged, and the damaged sheet may be pinched by carriage rollers and become difficult to remove.

SUMMARY OF THE INVENTION

It is the object of the present invention to provide a paper sheet carrying apparatus that allows a sheet to be removed with a relatively simple mechanism if a sheet during carriage remains in any one of two carriage paths or a sheet remains straddling both of two carriage paths due to occurrence of jam, etc.

A paper sheet carrying apparatus according to the present invention having a sheet path of a first unit and a sheet path of a second unit that are linked together by a linking device comprises a control mechanism for sending to the linking device to discharge a sheet remained on the way of the sheet paths from the first unit to the second unit due to the stop of carrying.

When the sheet is present on the sheet path of the second unit, the sheet is reversely carried to be sent to the linking device. When the sheet straddles the sheet path of the first unit and the sheet path of the second unit, a part of the sheet on the first unit side is carried forward and a part of the sheet on the second unit side is carried backward at the same time whereby the sheet is sent to the linking device.

The linking device includes a sending mechanism for sending the sheet to a predetermined direction and includes a collection box for collecting the collected sheets. The first unit is an external paper feeding apparatus; the second unit is an image forming apparatus; and the sheet sent to the linking device is the one that has not yet arrived where the image is to be transferred.

BRIEF DESCRIPTION OF THE DRAWINGS

FIG. 9 depicts a relationship between states of sheets and sensor detection.

PREFERRED EMBODIMENTS OF THE INVENTION

Figure 1:
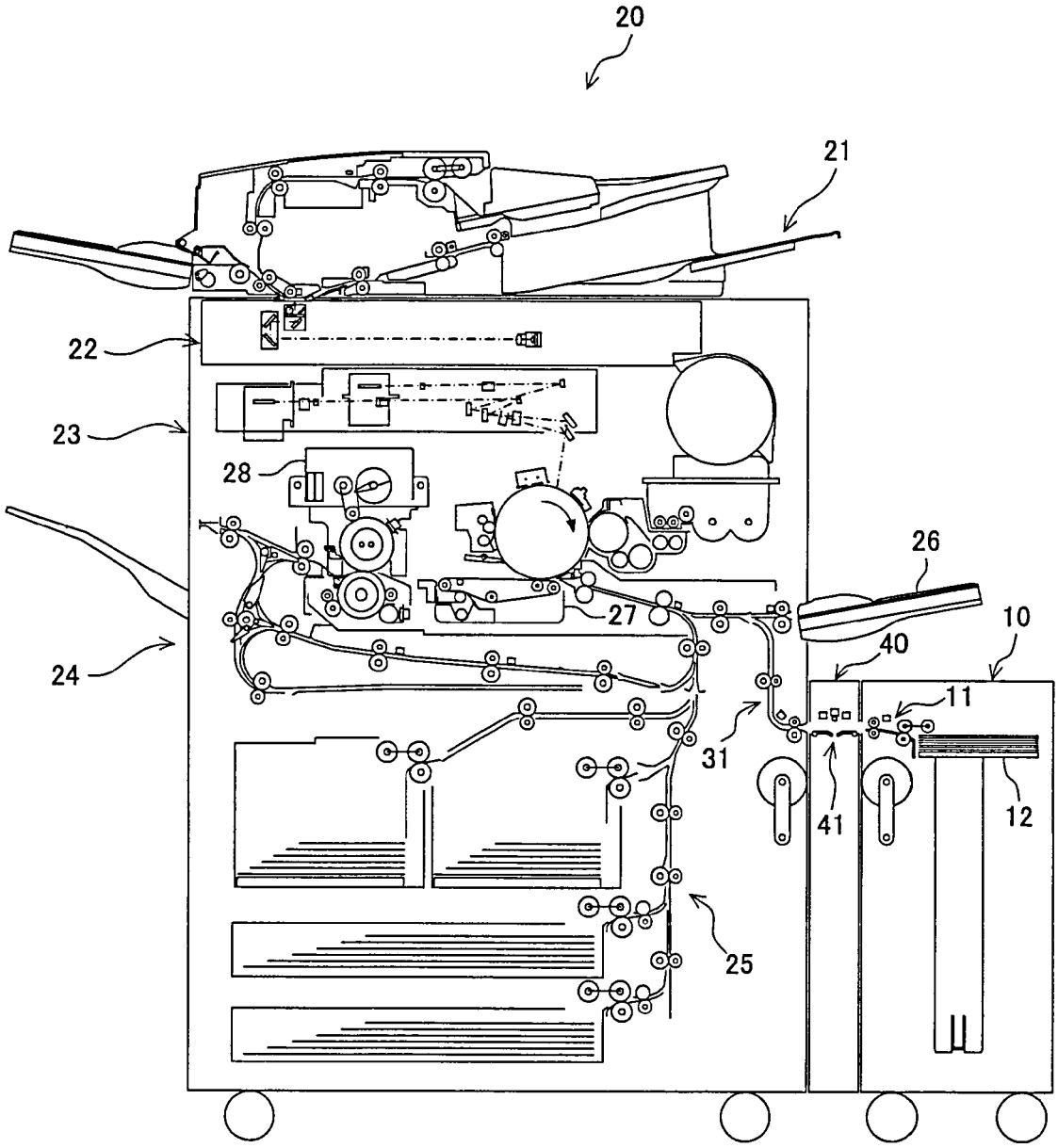
FIG. 1 is an explanatory view of an outline of the present invention by applying it to an image forming apparatus.

The embodiments of the present invention will be described with reference to the accompanying drawings. FIG. 1 depicts an example of using a paper sheet carrying apparatus of the present invention for carrying paper between an image forming apparatus used as a copier or a printer and a high-capacity external paper feeding apparatus. The paper sheet carrying apparatus of the present invention uses a high-capacity external paper feeding apparatus 10 as a first unit and an image forming apparatus 20 as a second unit, for example. A linking device 40 links a sheet path 11 of the external paper feeding apparatus 10 used as the first unit and a sheet path 31 of the image forming apparatus 20 used as the second unit carrying the sheet fed from the external paper feeding apparatus 10.

The image forming apparatus 20 acquires image data read out of a document or acquires image data externally received and outputs the image data onto recording paper (sheet). Main constituent portions include a document carrying portion 21, an image reading portion 22, a printing portion 23, a recording paper carrying portion 24, an internal paper feeding portion 25, a manual paper feeding portion 26, a transferring portion 27, and a fixing portion 28. When at least one document is set in a tray of the document carrying portion 21, the document is pulled out and carried from the tray and the document is read by the image reading portion 22. The image data read by the image reading portion 22 are output to the printing portion 23 after an image processing was performed on it through a control means such as a computer.

The printing portion 23 is a portion that records the read out image data onto the recording paper as an image; the transferring portion 27 attaches and transfers a toner image to the recording paper; and the fixing portion 28 heats and fixes the toner image. The recording paper carrying portion 24 includes a plurality of pairs of carriage rollers for carrying the recording paper, receives the recording paper from the internal paper feeding portion 25 or the manual paper feeding portion 26, and sends the recording paper to the transferring portion 27. The internal paper feeding portion 25 includes a plurality of paper feed trays to stores sheets in various sizes. Paper sheets in any size can be fed from the manual paper feeding portion 26 as needed.

The sheets can be fed by the internal paper feeding portion 25 and the manual paper feeding portion 26 built into the image forming apparatus 20 beforehand and also a large amount of copying and printing are possibly realized by linking the high-capacity external paper feeding apparatus 10 capable of feeding a large number of sheets to the apparatus 20. The high-capacity external paper feeding apparatus 10 can be used as the above first unit and the image forming apparatus 20 can be used as the second unit to feed the recording paper from the external paper feeding apparatus 10 to the image forming apparatus 20. The image forming apparatus 20 is provided with the carriage path 31 separately from the carriage path of sheets fed from the internal paper feeding portion 25 and the manual paper feeding portion 26, and sheets are fed to the transferring portion 27 through this carriage path 31. The external paper feeding apparatus 10 one-by-one pulls out the sheets from a paper feed tray 12 and feeds the sheets through the carriage path 11 to the carriage path 31 of the image forming apparatus 20.

In the present invention, the linking device 40 is disposed between the carriage path 11 of the external paper feeding apparatus 10 used as the above first unit (hereinafter, a first carriage path 11) and the carriage path 31 of the image forming apparatus 20 used as the second unit (hereinafter, a second carriage path 31) to link the first carriage path 11 and the second carriage path 31. The linking device 40 not only serves as a bridge that carries a sheet from the first carriage path 11 to the second carriage path 31, but also includes a function of receiving, collecting, and discharging a sheet remaining in and sent from the first and second carriage paths when jamming, etc., occur on the sheet carriage route and the drive of the carriage paths is stopped.

If carrying of sheets is interrupted in the image forming apparatus 20, all the sheets remaining in the carriage paths must be removed to restore the apparatus to the operable state. Therefore, if a sheet fed from the paper feed tray 12 of the external paper feeding apparatus 10 exists in the first carriage path 11 of the external paper feeding apparatus 10, the sheet is directly carried and sent to the linking device 40 through the normal forward direction carriage and is collected into the linking device 40 and discharged. If a sheet exists in the second carriage path 31 of the image forming apparatus 20, the sheet is returned and sent to the linking device 40 through the opposite direction carriage with the carriage direction reversed and is collected into the linking device 40 and discharged.

If the sheet is relatively large (long), the sheet may straddle both the external paper feeding apparatus 10 and the image forming apparatus 20. In this case, the sheet can also be sent to the linking device 40 and collected into the linking device 40 and discharged by driving the first carriage path 11 for the forward direction carriage concurrently with driving the second carriage path 31 for the opposite direction carriage. A sending mechanism 41 can be included that sends (drops) the sheet in a predetermined direction to certainly collect the sheet sent to the linking device 40. The sheets dropped into the linking device 40 are collected into, for example, a detachable collection box disposed under the linking device 40 and discharged.

If carrying of sheets is interrupted in the operation of the image forming apparatus 20 due to the occurrence of jam, etc., a plurality of sheets may remain and exist in both the first carriage path 11 of the external paper feeding apparatus 10 and the second carriage path 31 of the image forming apparatus 20. In this case, if a sheet straddling both the first and second carriage paths exists, this sheet is first removed. A sheet in the first carriage path 11 may then be removed and a sheet in the second carriage path 31 may be removed in sequence.

It is desirable that the sheet returned and collected from the second carriage path 31 of the image forming apparatus 20 is the one before arriving at the transferring portion 27 for recording an image. A sheet arriving at the transferring portion 27 and having a toner image already transferred thereon may be put into the fixed state and discharged to a discharge tray of printed sheets as described in Japanese Laid-Open Patent Publication No. 61-055054. This can prevent the toner image not fixed from contaminating the linking device 40.

The sending of sheets to the linking device and a sending mechanism sending a sheet in a predetermined direction in the linking device will be described with reference to FIGS. 2A to 9. In the following description, the external paper feeding apparatus 10 and the image forming apparatus 20 are referred to as the first unit and the second unit, respectively.

Figure 2A:
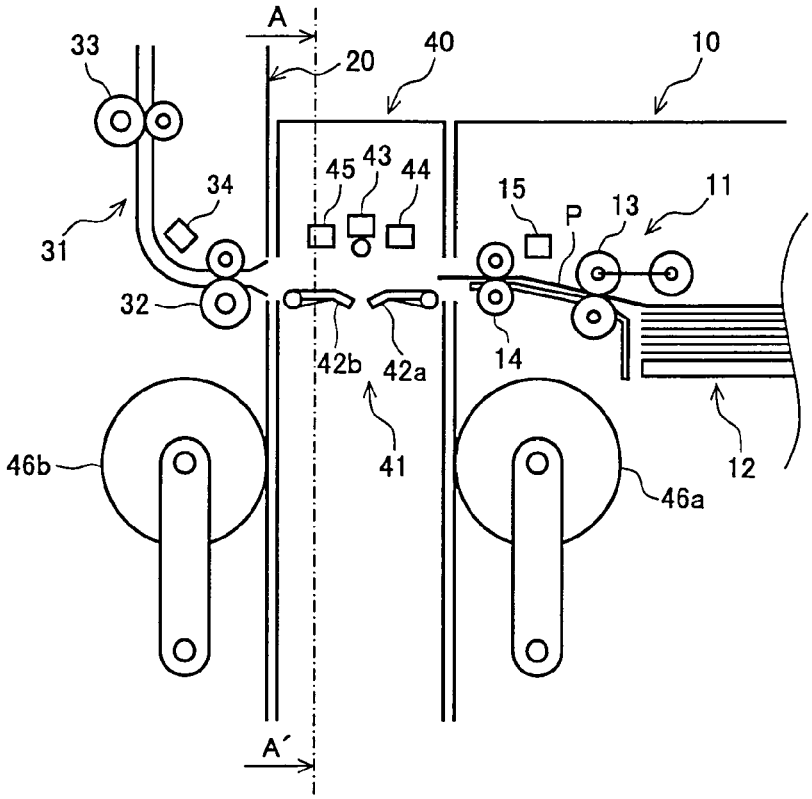
FIG. 2A is an explanatory view of an example when a sheet exists in a carriage path of a first unit.
Figure 2B:
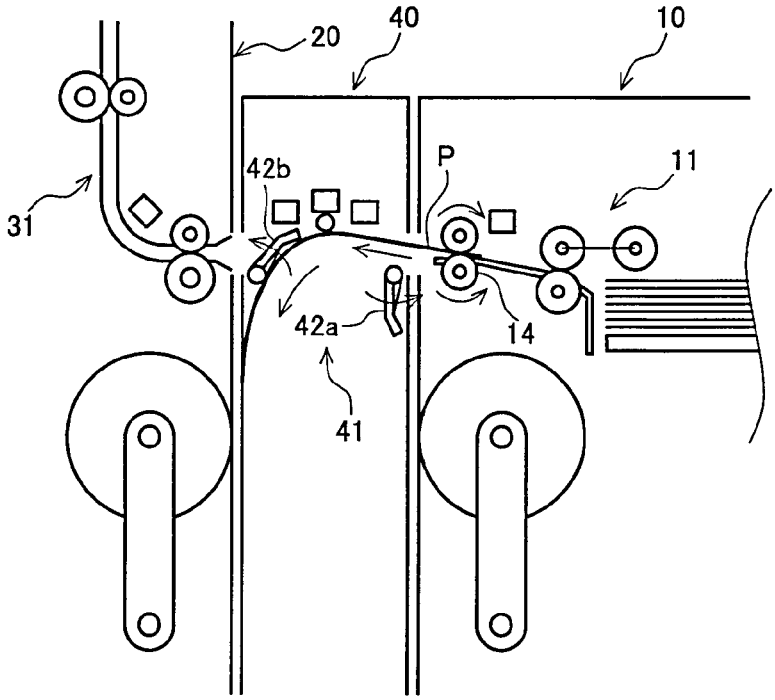
FIG. 2B is an explanatory view of a state of sending the sheet in the state of FIG. 2A into a linking device.
Figure 2C:
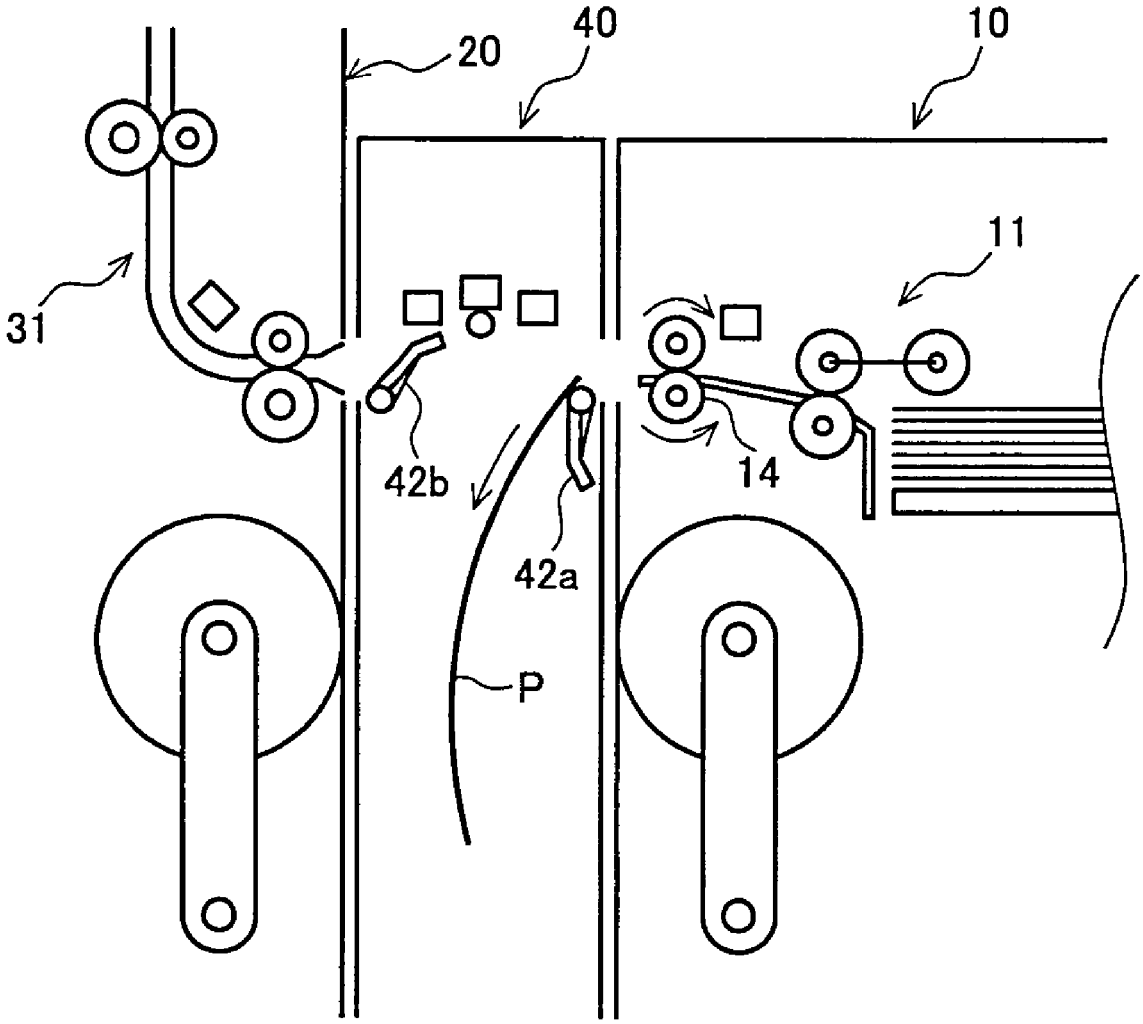
FIG. 2C is an explanatory view of a state of collecting the sheet in the state of FIG. 2B by the linking device.

FIGS. 2A to 2C depict an example when a sheet P exists in the first carriage path 11 of the first unit 10; FIG. 2A depicts a state of the sheet stopped in the carriage path; FIG. 2B depicts a state of sending the sheet P to the linking device 40; and FIG. 2C depicts a state of collecting the sheet P into the linking device 40. In FIGS. 2A to 2C, 13 denotes a pickup roller; 14 denotes a carriage roller; 15 denotes a first sensor; 32 and 33 denote carriage rollers; 34 denotes a fourth sensor; 42*a* and 42*b* denote guide levers; 43 denotes a drop rod apparatus; 44 denotes a second sensor; 45 denotes a third sensor; 46*a* and 46*b* denote pull-in rollers. Other reference numerals are the same as the reference numerals used in FIG. 1 and will not be described.

As shown in FIG. 2A, it is assumed that the sheet P is taken out from the paper feed tray 12 by the pickup roller 13 of the first carriage path 11 and carrying of the sheet is stopped while the carriage roller 14 grips the forward end (left end) of the sheet. In this case, since only the first sensor 15 detects the presence of the sheet P and the sheet p is not detected by the second sensor 44, the third sensor 45, and the fourth sensor 34, it is determined that the sheet P is in a state (1) representing that the sheet exists only in the carriage path of the first unit 10 as shown in FIG. 9. If the sheet P is detected only by the first and second sensors 15 and 44, it is also determined that the sheet P is in the state (1).

If the state (1) is detected, the carriage roller 14 of the first carriage path 11 is driven in the forward direction as shown in FIG. 2B and the sheet P is sent to the linking device 40. At the time of the state (1), the right guide lever 42*a* is rotated in the anticlockwise direction and opened downward, and the left guide lever 42*b* is also rotated in the anticlockwise direction to block the entrance to the second carriage path 31 to prevent the entry of the sheet P. Therefore, the front end of the sheet P sent from the first carriage path 11 is guided by the guide lever 42*b* to the lower part of the linking device 40.

When the rear end (right end) of the sheet P separates from the carriage roller 14 as shown in FIG. 2C, the sheet P is dropped to the lower part of the device in free fall along the guide lever 42*a* and collected.

Figure 3A:
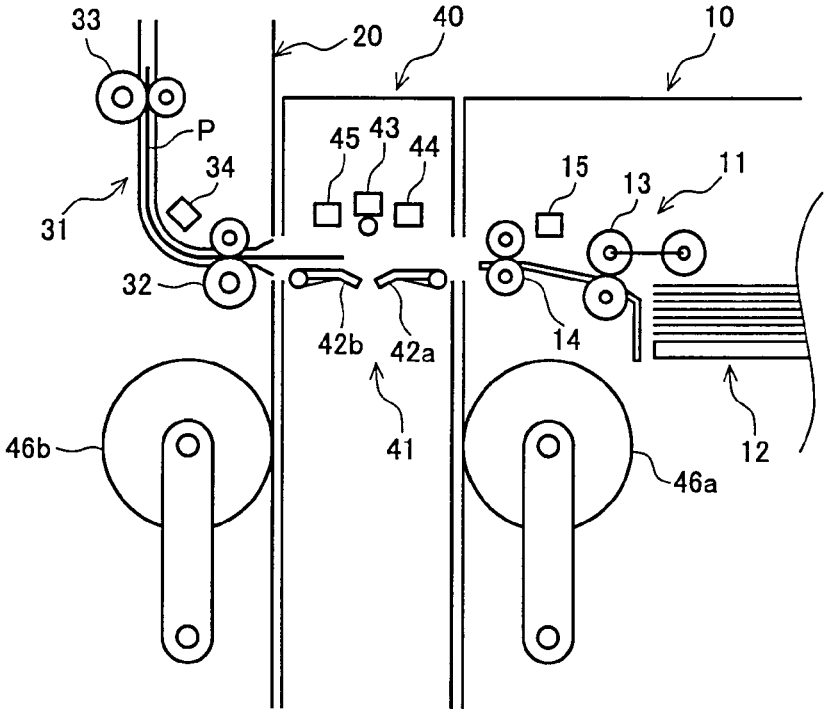
FIG. 3A is an explanatory view of an example when a sheet exists in a carriage path of a second unit.
Figure 3B:
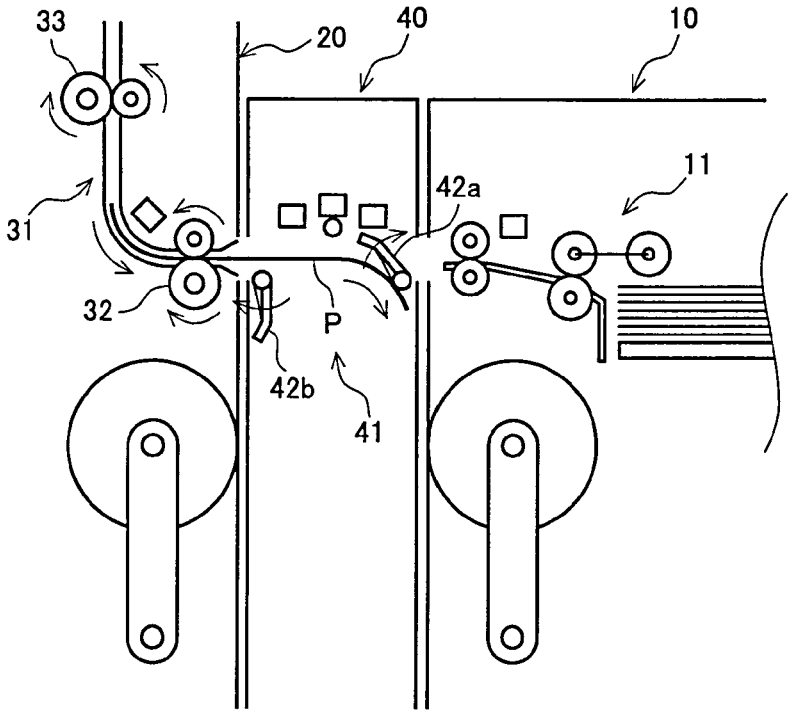
FIG. 3B is an explanatory view of a state of sending the sheet in the state of FIG. 3A into the linking device.
Figure 3C:
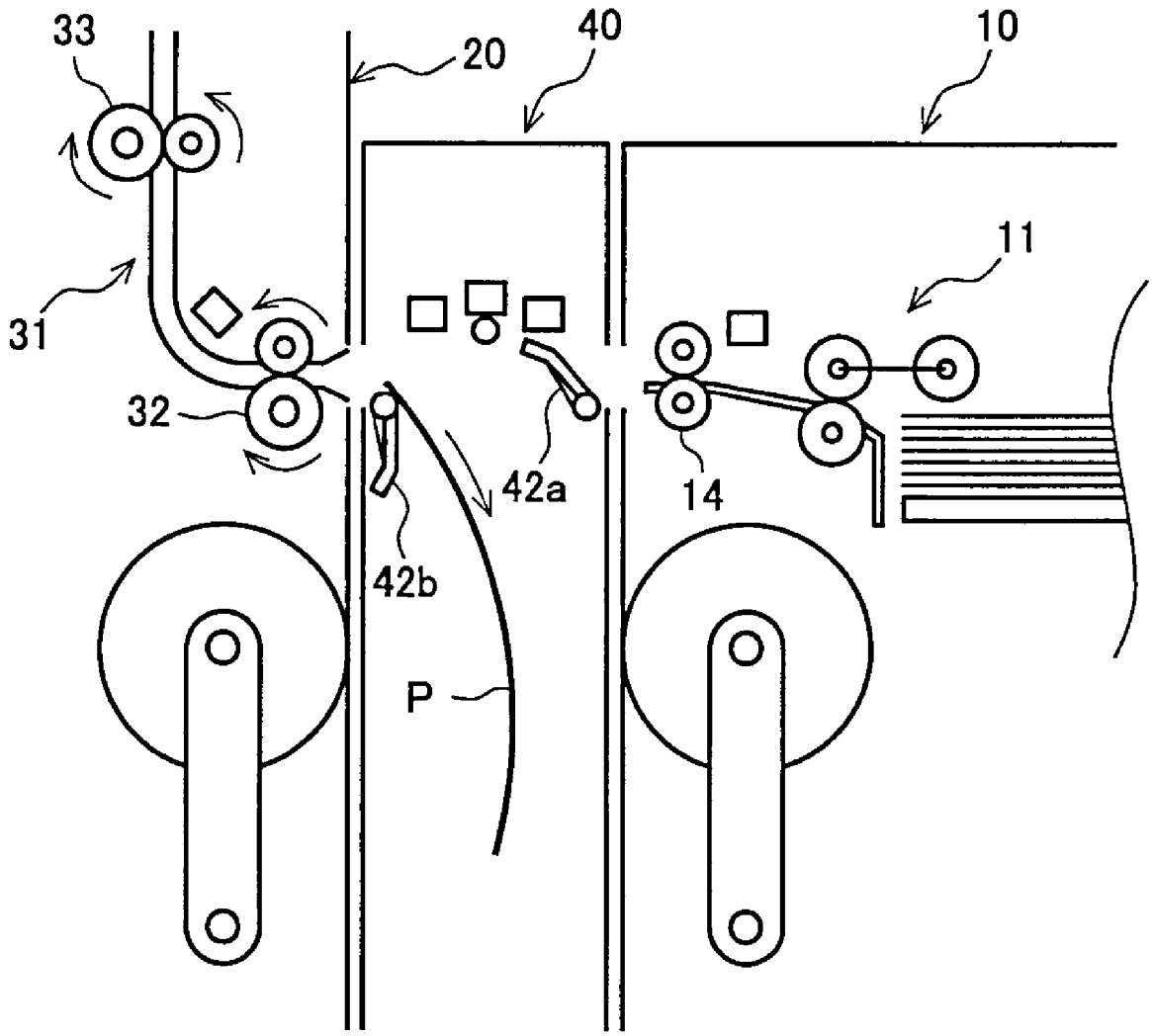
FIG. 3C is an explanatory view of a state of collecting the sheet in the state of FIG. 3B by the linking device.

FIGS. 3A to 3C depict an example when the sheet P exists in the second carriage path 31 of the second unit 20; FIG. 3A depicts a state of the sheet P stopped in the carriage path; FIG. 3B depicts a state of sending the sheet P to the linking device 40; and FIG. 3C depicts a state of collecting the sheet P into the linking device 40. The reference numerals of FIGS. 3A to 3C are the same as the reference numerals used in FIGS. 2A to 2C and will not be described.

As shown in FIG. 3A, it is assumed that the sheet P is carried in the forward direction from the first carriage path 11 and then carrying of the sheet is stopped while the sheet P is gripped by the carriage rollers 32 and 33 of the second carriage path 31. In this case, a determination is made since only the third sensor 45 and the fourth sensor 34 detect the presence of the sheet P and the sheet p is not detected by the first sensor 15 and the second sensor 44. It is determined that the sheet P is in a state (2) representing that the sheet exists only in the carriage path 31 of the second unit 20 as shown in FIG. 9. If only the fourth sensor 34 detects the sheet P, it is also determined that the sheet P is in the state (2).

The sheet passed through the carriage rollers 32 and 33 of the second carriage path 31 may be detected by a sensor (not shown) appropriately disposed in the carriage path 31 or the remaining position thereof may be detected by measuring the time from the point when the sheet passed through the fourth sensor 34.

If the state (2) is detected, the carriage rollers 32 and 33 of the second carriage path 31 are driven in the opposite direction reversed from the normal direction as shown in FIG. 3B and the sheet P is returned and sent to the linking device 40. At the time of the state (2), the left guide lever 42*b* is rotated in the clockwise direction and opened downward, and the right guide lever 42*a* is also rotated in the clockwise direction to block the entrance to the first carriage path 11 to prevent the entry of the sheet P. Therefore, the rear end of the sheet P sent from the second carriage path 31 is guided by the guide lever 42*a* to the lower part of the linking device 40.

When the front end of the sheet P separates from the carriage roller 14 as shown in FIG. 2C, the sheet P is dropped to the lower part of the device in free fall along the guide lever 42*b* and collected.

Figure 4A:
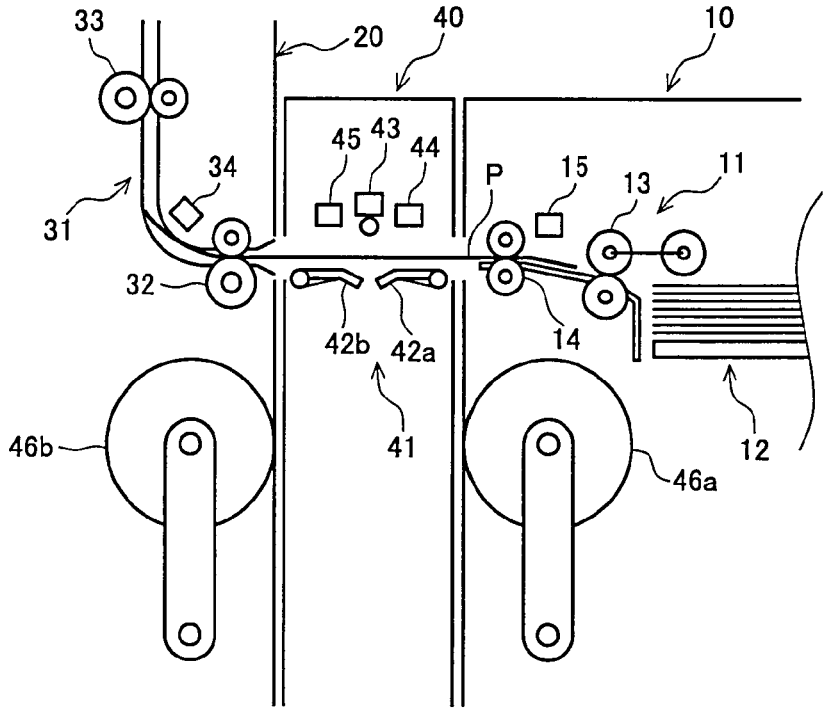
FIG. 4A is an explanatory view of an example when a sheet straddles both carriage paths of the first unit and the second unit 20.
Figure 4B:
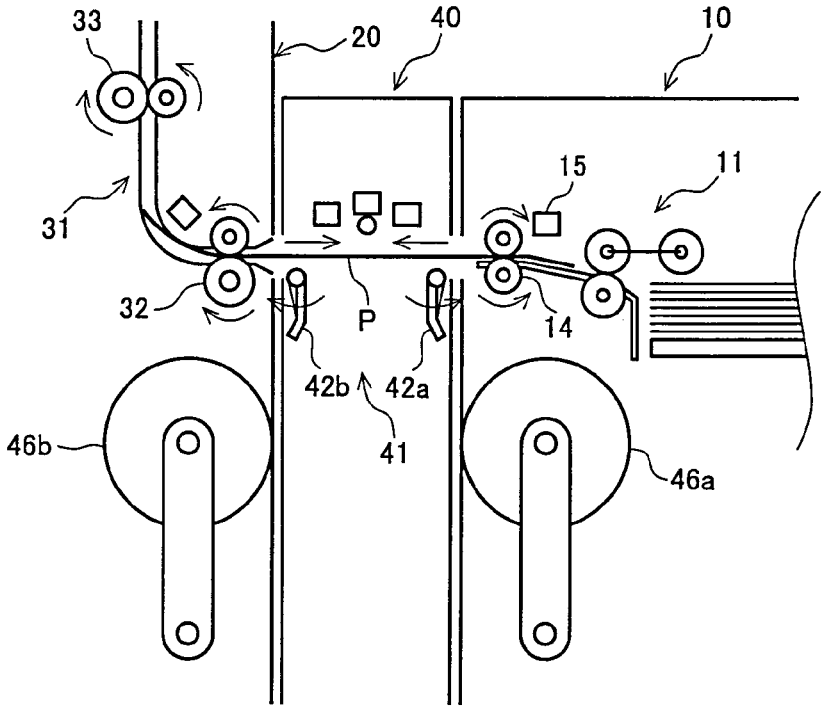
FIG. 4B is an explanatory view of a state of sending the sheet in the state of FIG. 4A into the linking device.
Figure 4C:
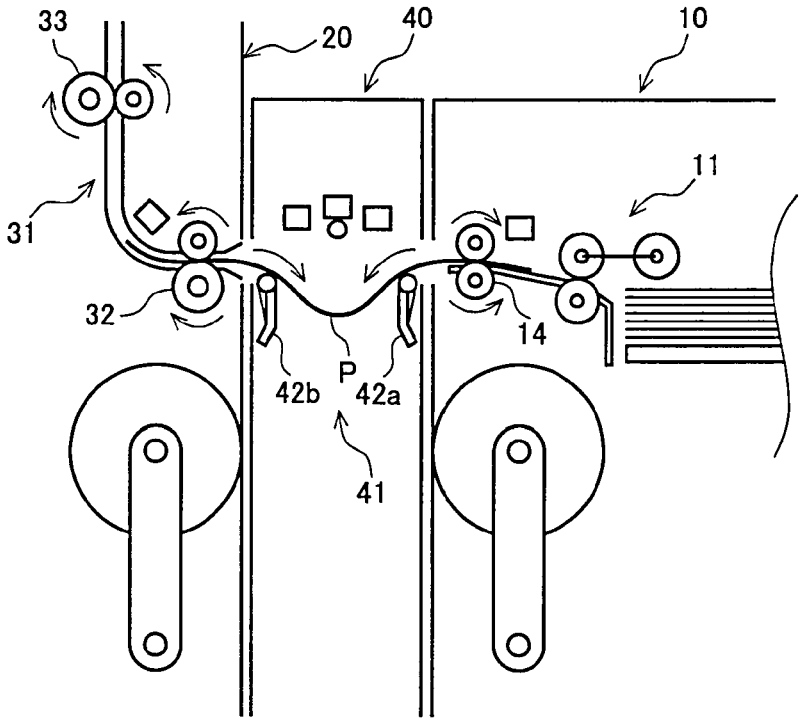
FIG. 4C is an explanatory view of a state of sending the sheet into the linking device continued from the state of FIG. 4B.
Figure 4D:
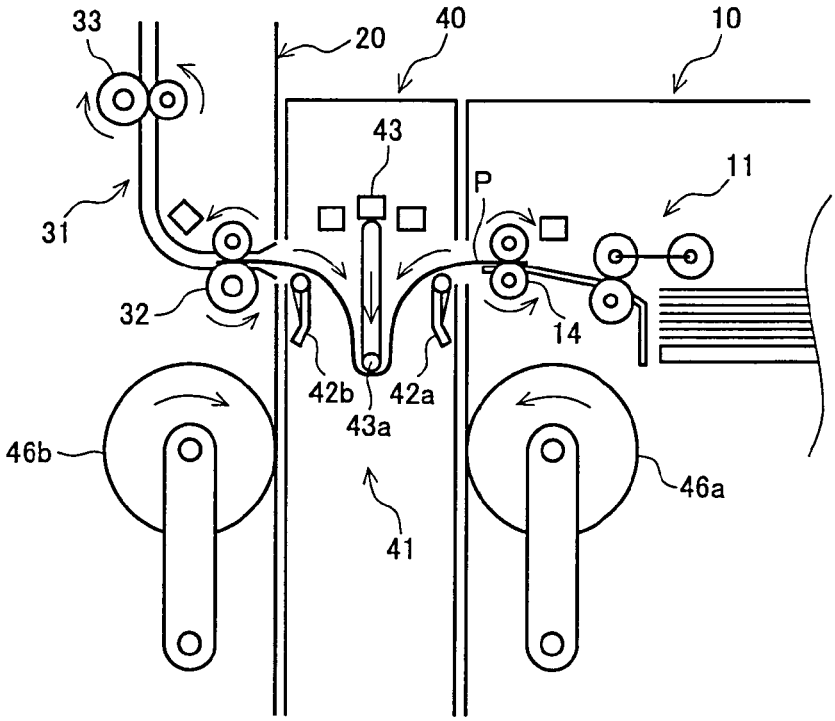
FIG. 4D is an explanatory view of a state of sending the sheet into the linking device continued from the state of FIG. 4C.

FIGS. 4A to 4H depict an example when the one sheet P straddles both the first carriage path 11 of the first unit 10 and the second carriage path 31 of the second unit 20. FIG. 4A depicts a state of the sheet P stopped in the carriage paths; FIGS. 4B to 4D depict states of sending the sheet P to the linking device 40; FIGS. 4E to 4H depict states of collecting the sheet P into the linking device 40. The reference numerals of FIGS. 4A to 4H are the same as the reference numerals used in FIGS. 2A to 2C and will not be described.

As shown in FIG. 4A, the sheet P may be long in the carriage direction and may straddle the first carriage path 11 and the second carriage path 31. It is assumed that carrying of the sheet P is stopped with the front end of the sheet P gripped by the carriage roller 32 of the second carriage path 31 and the rear end of the sheet P gripped by the carriage roller 14 of the first carriage path 11. In this case, a determination is made since the sheet P is detected by all of the first, second, third, and fourth sensors 15, 44, 45, and 34, and it is determined that the sheet P is in a state (3) representing that the sheet exists in the both carriage paths as shown in FIG. 9.

If the state (3) is detected, the carriage roller 14 of the first carriage path 11 is driven in the forward direction to send the sheet P to the linking device 40 while the carriage rollers 32 and 33 of the second carriage path 31 are driven in the opposite direction to send the sheet P to the linking device 40 as shown in FIG. 4B. At the time of the state (3), the right guide lever 42*a* is rotated in the anticlockwise direction and opened downward, and the left guide lever 42*b* is rotated in the clockwise direction and also opened downward such that the sheet P is easily dropped downward.

As shown in FIG. 4C, since the sheet P is concurrently sent to the linking device 40 from both the front end and the rear end, the intermediate portion of the sheet P slacks. Although slacking downwards can be allowed as shown in FIG. 4C, the sheet sometimes slacks upwards. If slacking upwards occurs, the sheet blocks the carriage path and becomes difficult to be collected, and it becomes difficult to restore the apparatus to the operable state. Therefore, the drop rod apparatus 43 is disposed on the upper middle portion of the linking device 40, for example.

As shown in FIG. 4D, when the sheet P is sent into the linking device 40, a rod 43*a* of the drop rod apparatus 43 is actuated downwards and the sheet P is moved to the lower part of the linking device 40 such that the slacked center portion of the sheet P is folded in two.

Figure 4E:
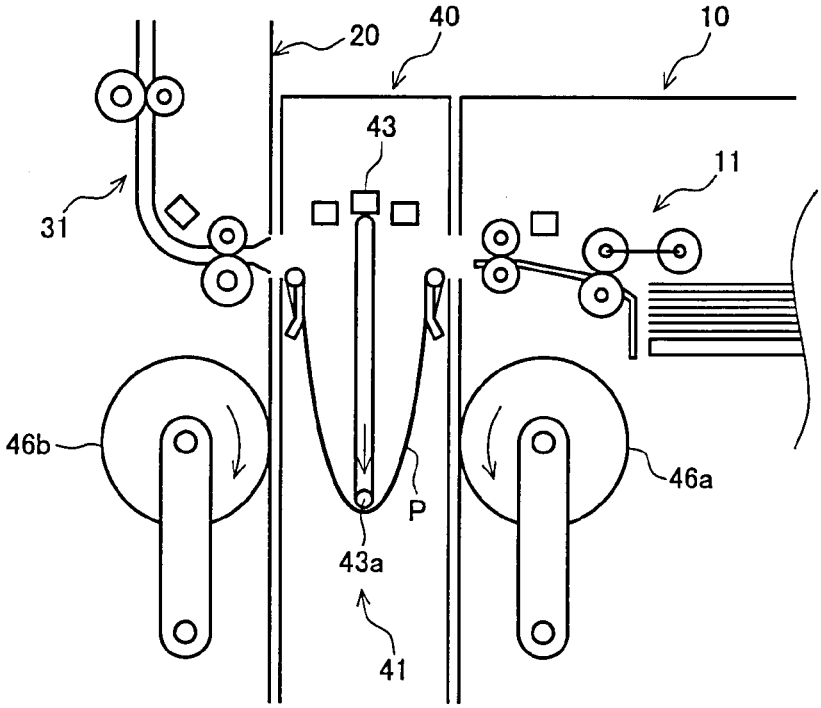
FIG. 4E is an explanatory view of a state of collecting the sheet in the state of FIG. 4D in the linking device.
Figure 4F:
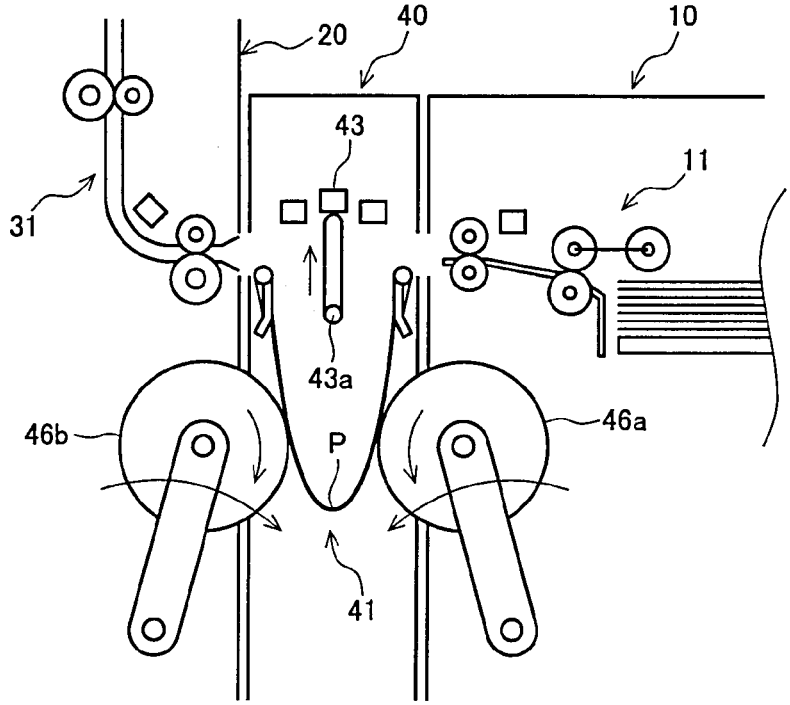
FIG. 4F is an explanatory view of a state of collecting the sheet in the linking device continued from the state of FIG. 4E.

When each of the front and rear ends of the sheet P separates from the carriage rollers as shown in FIG. 4E, the rod 43*a* of the drop rod apparatus 43 moves the sheet P folded in two closer to the pull-in rollers 46*a* and 46*b* disposed on both sides of the linking device 40. When the sheet P is moved to a predetermined position, the pull-in rollers 46*a* and 46*b* are rotated and tilted to the inside such that the rollers are approached to each other as shown in FIG. 4F. The rod 43*a* of the drop rod apparatus 43 is returned to the upper home position in conjunction with the operation of the pull-in rollers 46*a* and 46*b*.

Figure 4G:
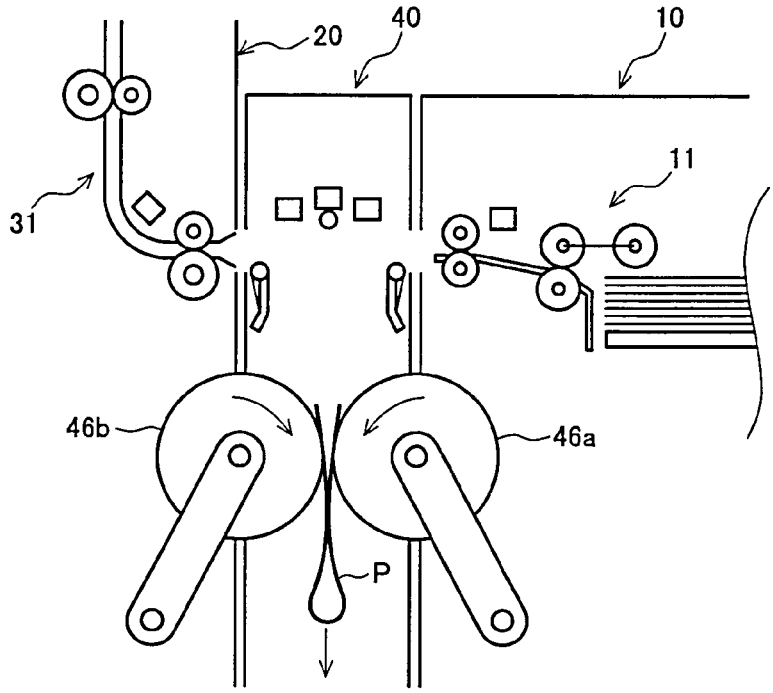
FIG. 4G is an explanatory view of a state of collecting the sheet in the linking device continued from the state of FIG. 4F.
Figure 4H:
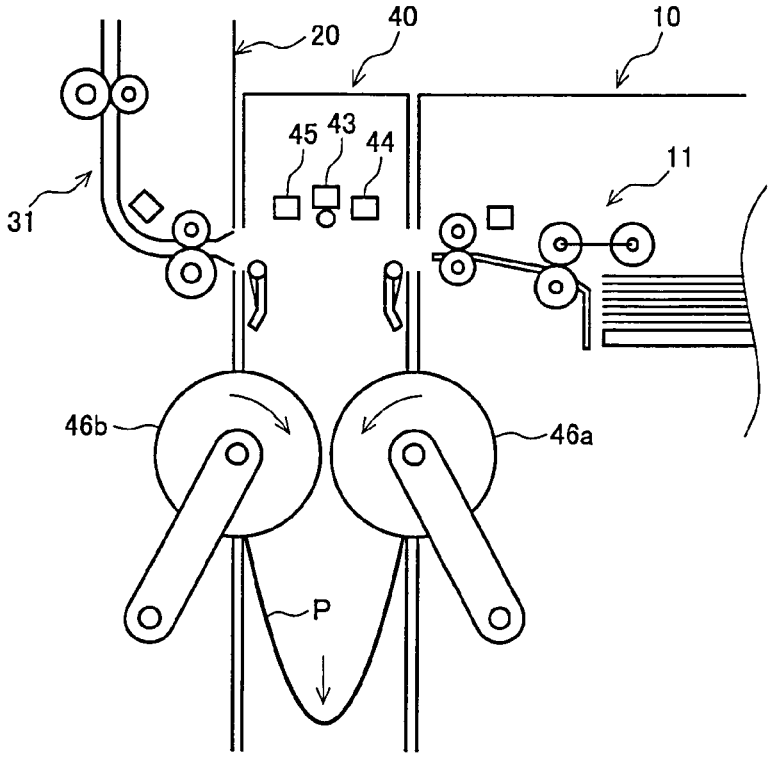
FIG. 4H is an explanatory view of a state of collecting the sheet in the linking device continued from the state of FIG. 4G.

As shown in FIG. 4G, the pull-in rollers 46*a* and 46*b* pinch and move the doubled sheet P from the both sides such that the sheet is pulled downwards. When the sheet P separates from the pull-in rollers 46*a* and 46*b*, the sheet P is freely dropped, collected, and discharged onto the bottom of the linking device 40. The sheet can easily be collected and discharged by disposing a detachable collection box, etc., on the lower part of the linking device 40.

Figure 5A:
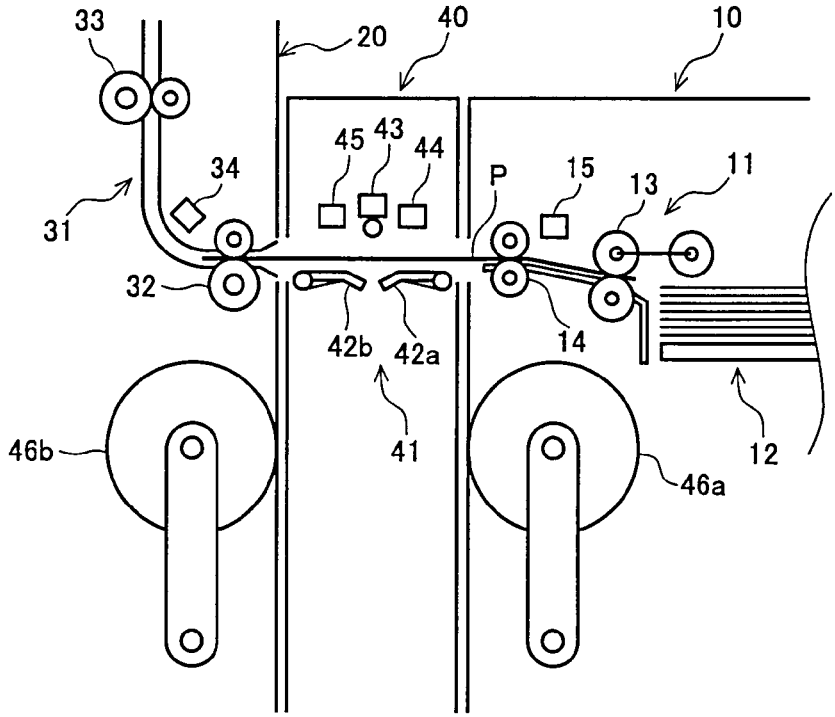
FIG. 5A depicts an example when somewhat larger part of the sheet exists in the carriage path of the first unit in FIG. 4A.
Figure 5B:
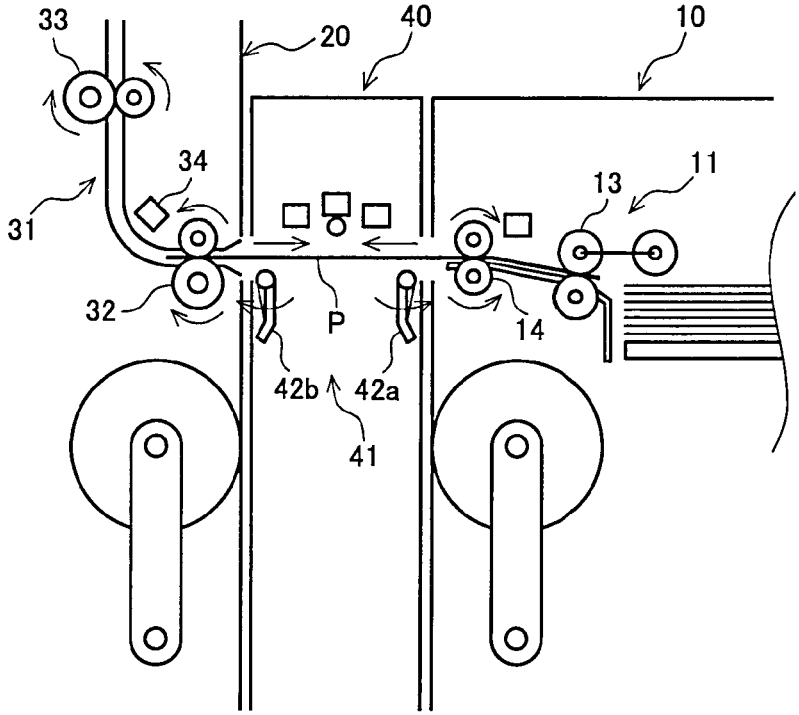
FIG. 5B is an explanatory view of a state of sending the sheet in the state of FIG. 5A into the linking device.

FIGS. 5A and 5B depict an example when the one sheet P straddles both the first carriage path 11 of the first unit 10 and the second carriage path 31 of the second unit 20 in the same manner as in the example of FIG. 4A and somewhat larger part of the sheet exists in the first carriage path 11. FIG. 5A depicts a state of the sheet stopped in the carriage paths and FIG. 5B depicts a state of sending the sheet to the linking device 40. The reference numerals of FIGS. 5A and 5B are the same as the reference numerals used in FIGS. 2A to 2C and will not be described.

As shown in FIG. 5A, it is assumed that carrying of the sheet P is stopped with the rear end of the sheet P gripped by the pickup roller 13 and the carriage roller 14 in the first carriage path 11 and the front end of the sheet P slightly gripped by the carriage roller 32 in the second carriage path 31. In this case, a determination is made since the sheet P is detected by the first, second, and third sensors 15, 44, and 45 and the sheet P is not detected by the fourth sensor 34. It is also determined in this case that the sheet P is in the state (3) representing that the sheet exists in the both carriage paths as shown in FIG. 9.

If the state (3) is detected, the carriage roller 14 of the first carriage path 11 is driven in the forward direction to send the sheet P to the linking device 40 while the carriage rollers 32 and 33 of the second carriage path 31 are driven in the opposite direction to send the sheet P to the linking device 40 from the both sides in the same manner as in the case shown in FIG. 4B. In this case, the front end of the sheet P separates from the carriage roller 32 earlier and the carriage roller 14 still grips the sheet. Therefore, the front end of the sheet P separated earlier from the carriage roller may be pushed back again to the second carriage path 31 or flipped upwards. Although the left guide lever 42*b* can instantaneously be actuated at this point to achieve the state of FIG. 2B, it is difficult to make the timing right.

Therefore, as shown in FIG. 4D, it is desirable to operate the drop rod apparatus 43 disposed on the upper middle portion of the linking device 40. In this case, while the rear end of the sheet P is gripped by the carriage roller 14, the rod 43*a* of the drop rod apparatus 43 is actuated downwards and the sheet P is moved to the lower part of the linking device 40 such that the center portion of the sheet P is folded. If the sheet P can be dropped in the state of folded in two, the sheet P can subsequently be collected and discharged onto the bottom of the linking device 40 in the form shown in FIGS. 4E to 4H. The sheet may be collected and discharged in the form of FIGS. 2B to 2C depending on the timing of separation from the carriage roller 32.

Figure 6A:
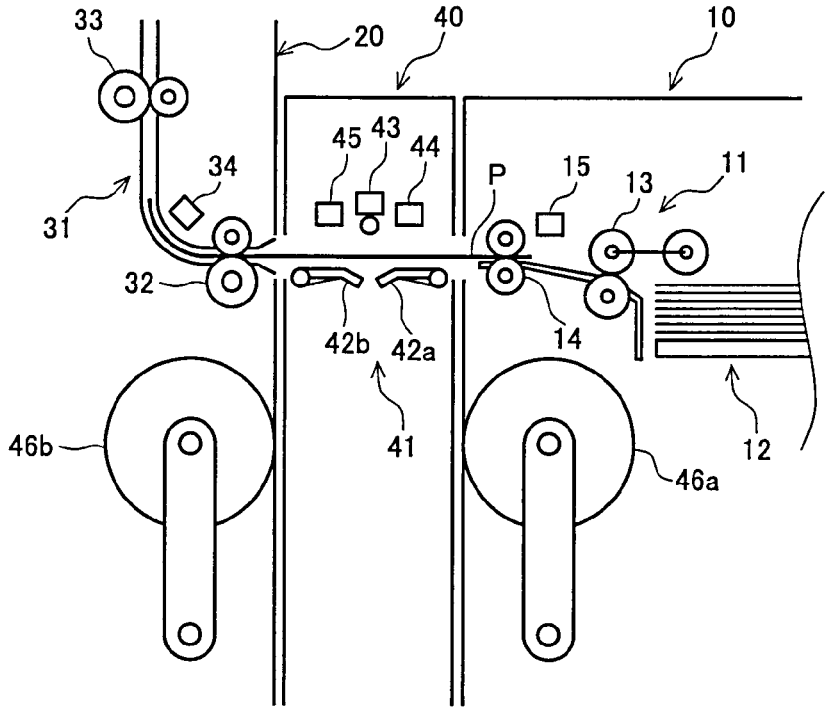
FIG. 6A shows an example when somewhat larger part of the sheet exists in the carriage path of the second unit in FIG. 4A.
Figure 6B:
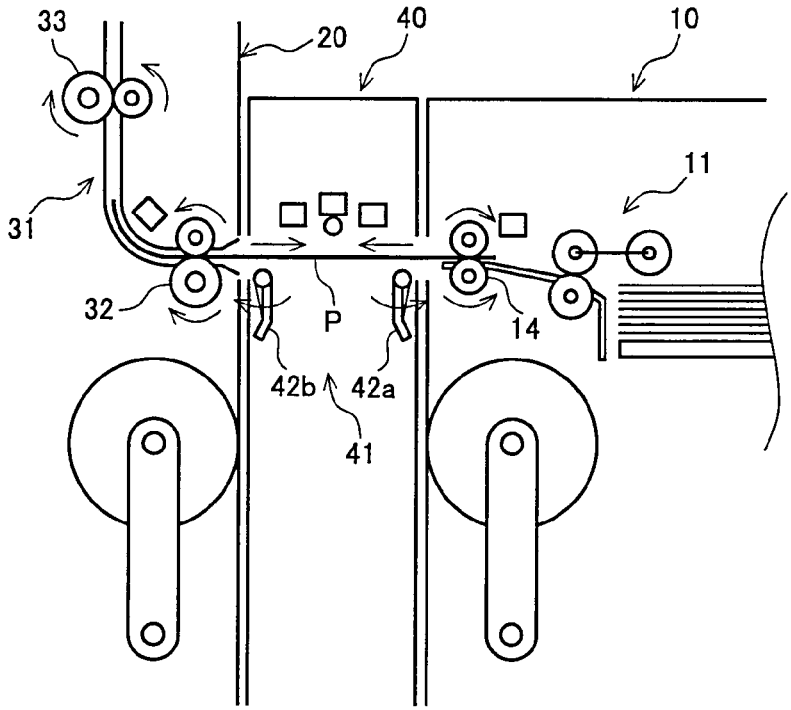
FIG. 6B is an explanatory view of a state of sending the sheet in the state of FIG. 6A into the linking device.

FIGS. 6A and 6B depict an example when the one sheet P straddles both the first carriage path 11 of the first unit 10 and the second carriage path 31 of the second unit 20 and somewhat larger part of the sheet exists in the second carriage path 31 as compared to the example of FIG. 5A. FIG. 6A depicts a state of the sheet stopped in the carriage paths and FIG. 6B depicts a state of sending the sheet to the linking device 40. The reference numerals of FIGS. 6A and 6B are the same as the reference numerals used in FIGS. 2A to 2C and will not be described.

As shown in FIG. 6A, it is assumed that carrying of the sheet P is stopped while the carriage roller 32 grips a near center portion on the rear end side of the sheet P in the second carriage path 31 and the carriage roller 14 slightly grips the rear end of the sheet P in the first carriage path 11. In this case, a determination is made since the sheet P is detected by the second, third, and fourth sensors 44, 45, and 34 and the sheet P is not detected by the first sensor 15. It is also determined in this case that the sheet P is in the state (3) representing that the sheet exists in the both carriage paths as shown in FIG. 9.

If the state (3) is detected, the carriage roller 14 of the first carriage path 11 is driven in the forward direction to send the sheet P to the linking device 40 while the carriage rollers 32 and 33 of the second carriage path 31 are driven in the opposite direction to send the sheet P to the linking device 40 in the same manner as in the case shown in FIG. 4B. In this case, the rear end of the sheet P separates from the carriage roller 14 earlier and the carriage roller 32 still grips the sheet. Therefore, the rear end of the sheet P separated earlier from the carriage roller may be pushed back again to the first carriage path 11 or flipped upwards. Although the right guide lever 42*a* can instantaneously be actuated at this point to achieve the state of FIG. 3B, it is difficult to make the timing right.

Therefore, as shown in FIGS. 5A to 5B, it is desirable to operate the drop rod apparatus 43 disposed on the upper middle portion of the linking device 40. In this case, while the front end of the sheet P is gripped by the carriage roller 32, the rod 43*a* of the drop rod apparatus 43 is actuated downwards and the sheet P is moved to the lower part of the linking device 40 such that the center portion of the sheet P is folded. If the sheet P can be dropped in the state of folded in two, the sheet P can subsequently be collected and discharged onto the bottom of the linking device 40 in the form shown in FIGS. 4E to 4H. The sheet may be collected and discharged in the form of FIGS. 3B to 3C depending on the timing of separation from the carriage roller 14.

In the forms of FIGS. 5A to 6B, the carriage roller having a larger portion of the sheet may be driven somewhat later than the carriage roller having a smaller portion of the sheet to make the both ends of the sheet separate from the both carriage rollers at the same timing. In this case, the sheet can be collected in the form same as that shown in Figures following FIG. 4C.

Figure 7A:
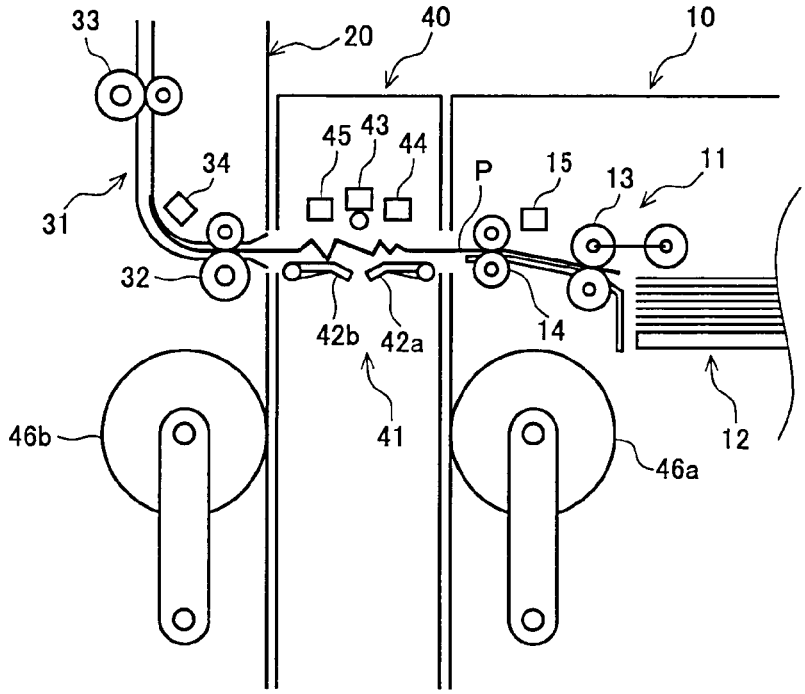
FIG. 7A is an explanatory view of an example when the sheet straddling both carriage paths of the first unit and the second unit 20 is jammed.
Figure 7B:
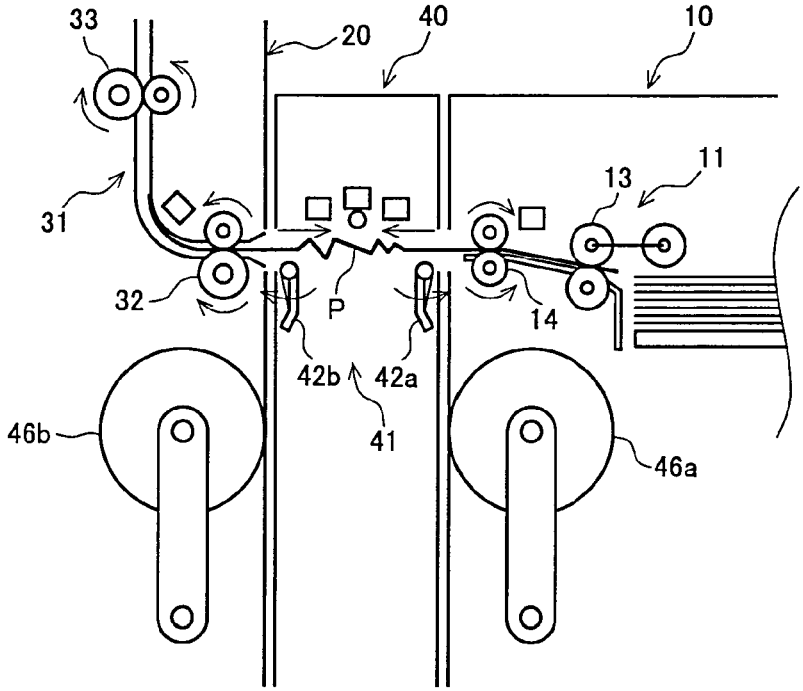
FIG. 7B is an explanatory view of a state of sending the sheet in the state of FIG. 7A into the linking device.
Figure 7C:
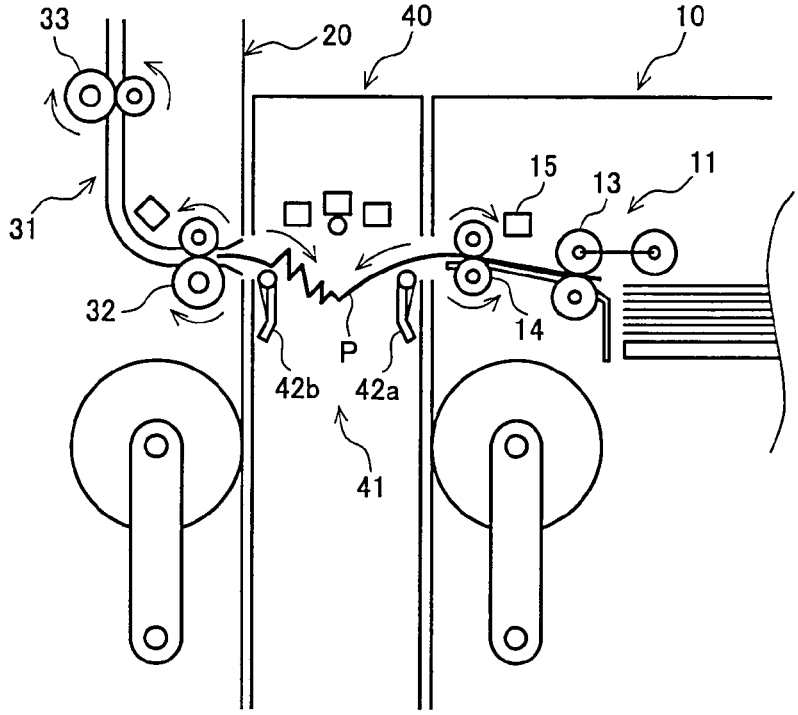
FIG. 7C is an explanatory view of a state of sending the sheet into the linking device continued from the state of FIG. 7B.
Figure 7D:
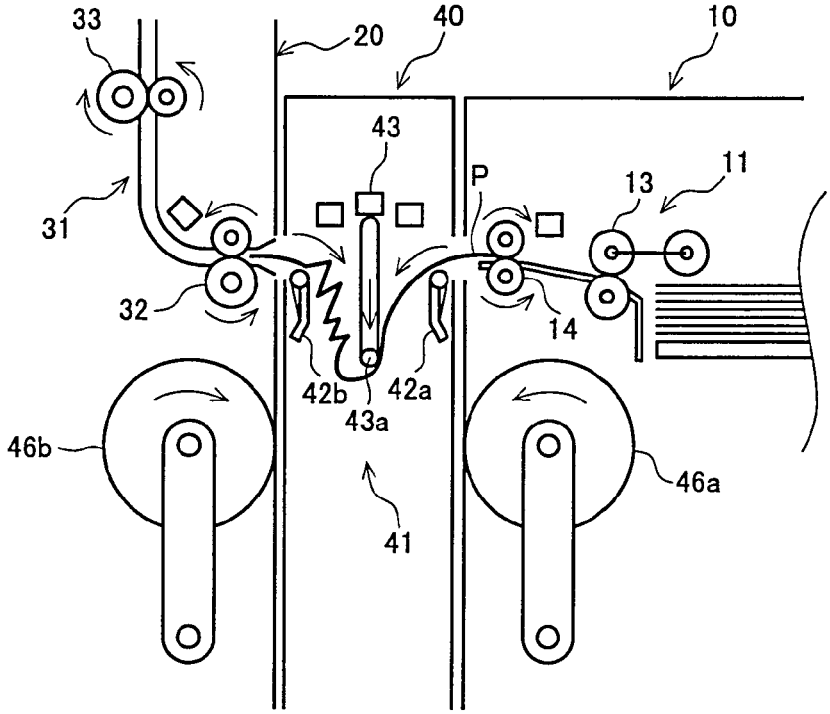
FIG. 7D is an explanatory view of a state of sending the sheet into the linking device continued from the state of FIG. 7C.

FIGS. 7A to 7H depict an example when the sheet straddling both the first carriage path 11 of the first unit 10 and the second carriage path 31 of the second unit 20 is jammed. FIG. 7A depicts a state of the jammed sheet P stopped in the carriage paths; FIGS. 7B to 7D depict states of sending the jammed sheet P to the linking device 40; FIGS. 7E to 7H depict states of collecting the jammed sheet P into the linking device 40. The reference numerals of FIGS. 7A to 7H are the same as the reference numerals used in FIGS. 2A to 2C and will not be described.

As shown in FIG. 7A, the sheet P may be long in the carriage direction and may be jammed while straddling the first carriage path 11 and the second carriage path 31. It is assumed that carrying of the jammed sheet P is stopped with the front end of the jammed sheet P gripped by the carriage roller 32 of the second carriage path 31 and the rear end of the jammed sheet P gripped by the carriage roller 14 of the first carriage path 11. In this case, a determination is made since the jammed sheet P is detected by all of the first, second, third, and fourth sensors 15, 44, 45, and 34, and it is determined that the jammed sheet P is in the state (3) representing that the sheet exists in the both carriage paths in the same manner as in the example shown in FIG. 4A.

If the state (3) is detected, the carriage roller 14 of the first carriage path 11 is driven in the forward direction to send the jammed sheet P to the linking device 40 while the carriage rollers 32 and 33 of the second carriage path 31 are driven in the opposite direction to send the jammed sheet P to the linking device 40 as shown in FIG. 7B. At the time of the state (3), the right guide lever 42*a* is rotated in the anticlockwise direction and opened downward, and the left guide lever 42*b* is rotated in the clockwise direction and also opened downward such that the jammed sheet P is easily dropped downwards.

As shown in FIG. 7C, since the jammed sheet P is sent to the linking device 40 from both the front end and the rear end, the intermediate portion of the sheet P slacks. Although slacking downwards can be allowed as shown in FIG. 7C, the sheet sometimes slacks upwards. If slacking upwards occurs, the sheet blocks the carriage path and becomes difficult to be collected, and it becomes difficult to restore the apparatus to the operable state. Therefore, the drop rod apparatus 43 is disposed on the upper middle portion of the linking device 40.

As shown in FIG. 7D, when the jammed sheet P is sent into the linking device 40, the rod 43*a* of the drop rod apparatus 43 is actuated downwards and the jammed sheet P is moved to the lower part of the linking device 40 such that the slacked center portion of the jammed sheet P is folded in two.

Figure 7E:
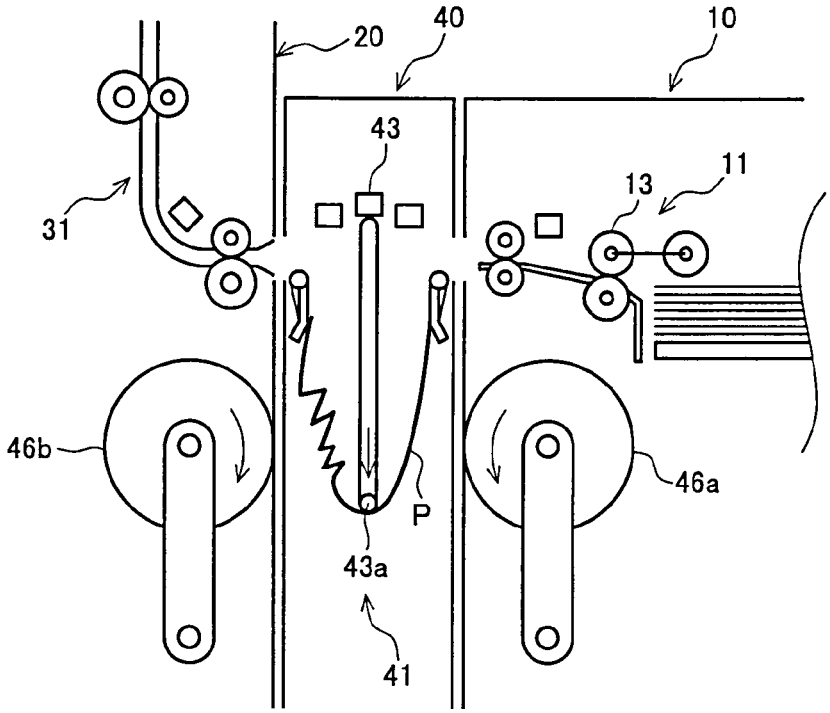
FIG. 7E is an explanatory view of a state of collecting the sheet in the state of FIG. 7D in the linking device.
Figure 7F:
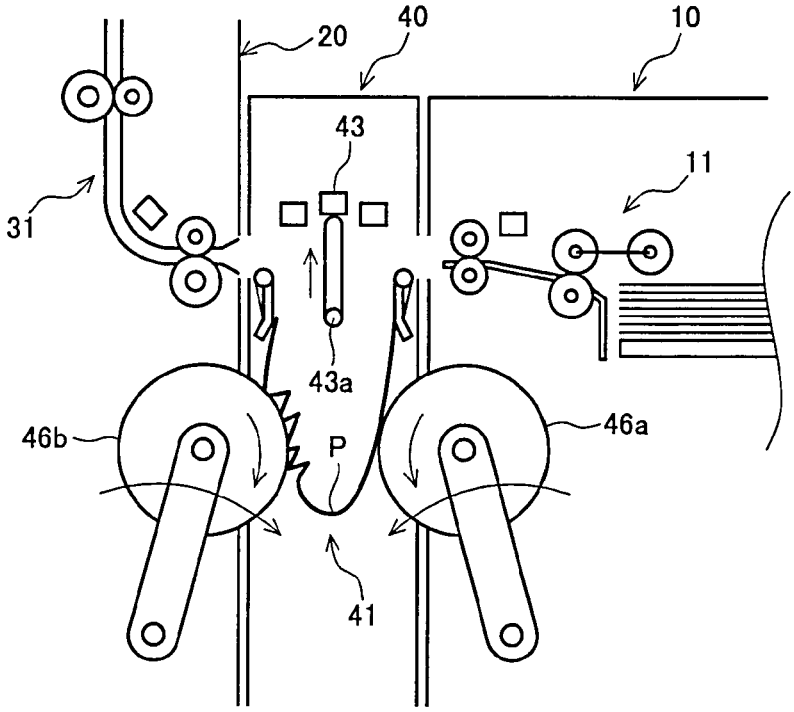
FIG. 7F is an explanatory view of a state of collecting the sheet in the linking device continued from the state of FIG. 7E.

When each of the front and rear ends of the jammed sheet P separates from the carriage rollers as shown in FIG. 7E, the rod 43*a* of the drop rod apparatus 43 moves the sheet P folded in two closer to the pull-in rollers 46*a* and 46*b* disposed on both sides of the linking device 40. When the sheet P is moved to a predetermined position, the pull-in rollers 46*a* and 46*b* are rotated and tilted to the inside such that the rollers are approached to each other as shown in FIG. 7F. The rod 43*a* of the drop rod apparatus 43 is returned to the upper home position in conjunction with the operation of the pull-in rollers 46*a* and 46*b*.

Figure 7G:
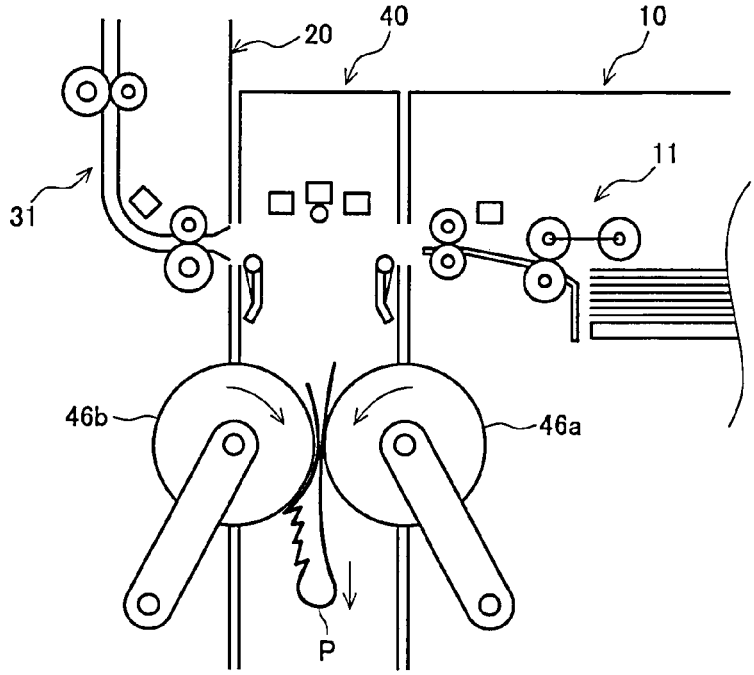
FIG. 7G is an explanatory view of a state of collecting the sheet in the linking device continued from the state of FIG. 7F.
Figure 7H:
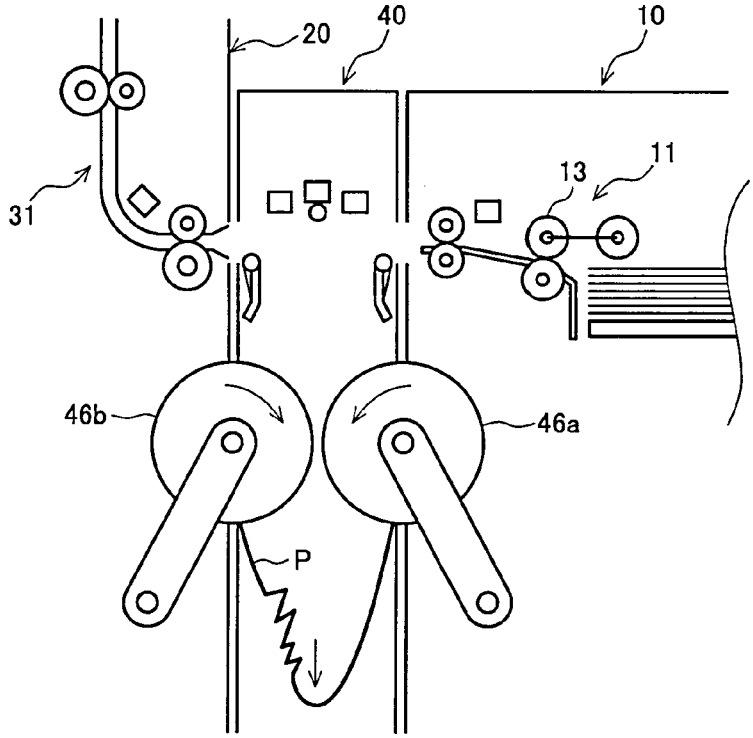
FIG. 7H is an explanatory view of a state of collecting the sheet in the linking device continued from the state of FIG. 7G.

As shown in FIG. 7G, the pull-in rollers 46*a* and 46*b* pinch and move the doubled sheet P from the both sides such that the sheet is pulled downwards. When the sheet P separates from the pull-in rollers 46*a* and 46*b* as shown in FIG. 7H, the jammed sheet P is freely dropped, collected, and discharged onto the bottom of the linking device 40. The sheet can easily be collected and discharged by disposing a detachable collection box, etc., on the lower part of the linking device 40.

Figure 8A:
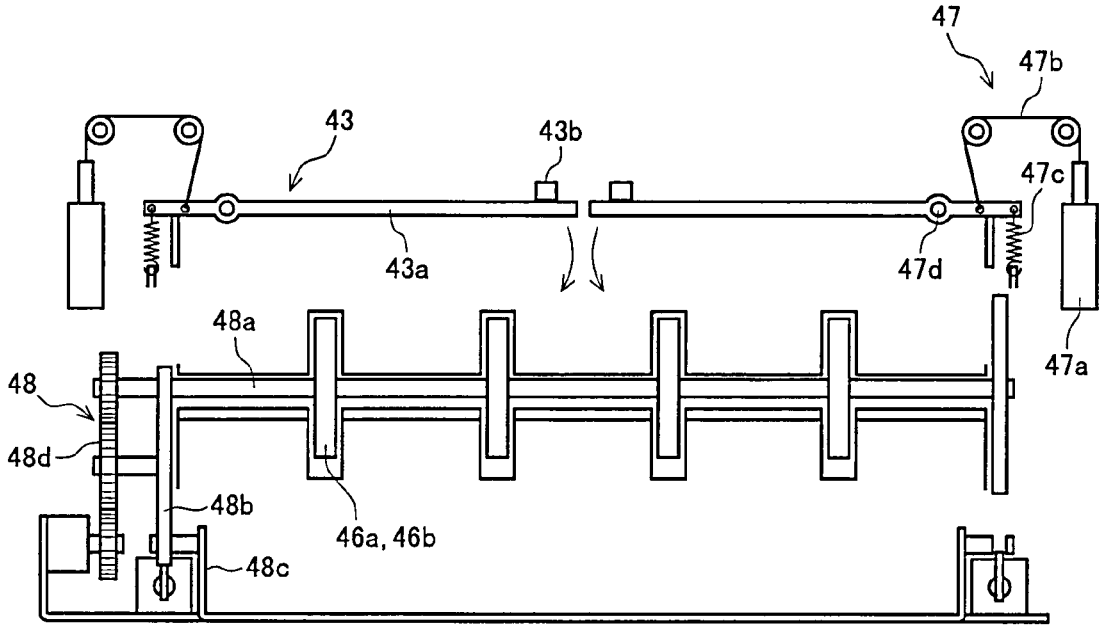
FIGS. 8A and 8B are explanatory views of an example of a sending mechanism that drops a sheet into the linking device.
Figure 8B:
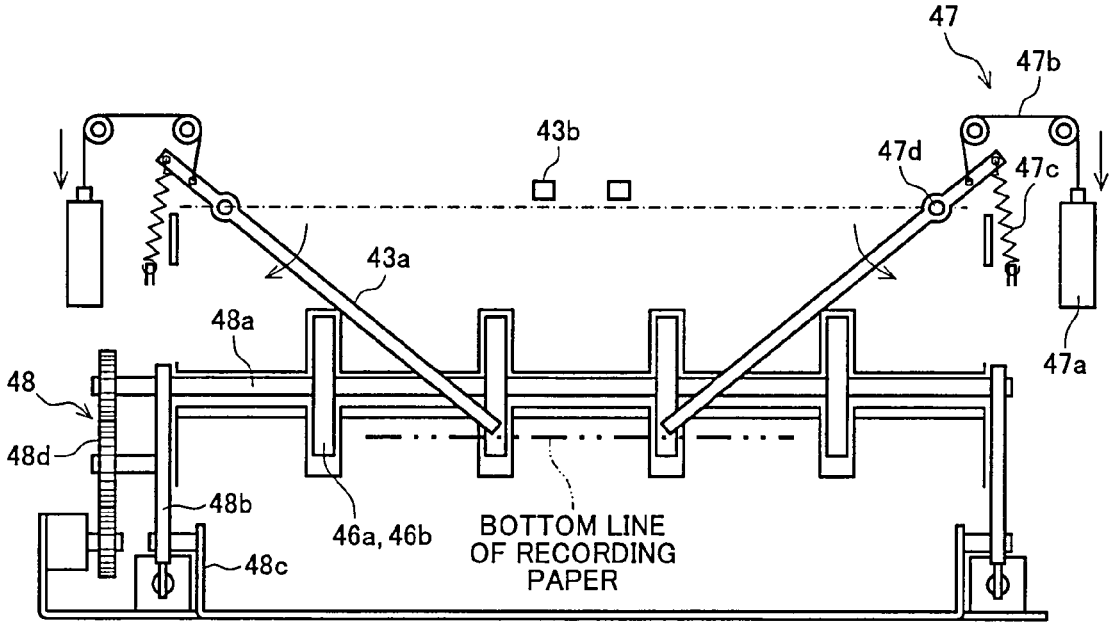

FIGS. 8A and 8B depict an example of the sending mechanism that sends (drops) a sheet into the linking device and are views seen from A-A' direction of FIG. 2A. FIG. 8A depicts the inactive state and FIG. 8B depicts the active state.

The sending mechanism 41 includes the drop rod apparatus 43 and a pull-in apparatus 48. The drop rod apparatus 43 prevents the sheet sent to the linking device from being flipped upwards or the slacking portion from being pushed up and directs the sheet downwards as in the operating state described in FIGS. 4D to 4F.

For example, the drop rod apparatus 43 can be configured such that the symmetrically and rotatably disposed rod 43*a* is actuated by a driving apparatus 47. The driving apparatus 47 is composed of an electromagnetic plunger 47*a*, a drive wire 47*b*, a spring 47*c*, and a support shaft 47*d*, for example. The rod 43*a* is touched a stop piece 43*b* by a bias force of the spring 47*c* to be in a substantially horizontal state as shown in FIG. 8A. The electromagnetic plunger 47*a* is activated through the drive wire 47*b* to rotate the rod 43*a* in a direction of an arrow against the bias force of the spring 47*c* as shown in FIG. 8B.

The rod 43*a* is rotated and contacts the center portion of the sheet sent to the linking device at the leading end thereof and the sheet is folded in two and dropped downwards. After this, by canceling the magnetization of the electromagnetic plunger 47*a*, the rod 43*a* is returned to and stopped at the position touching the stop piece 43*b* due to the bias force of the spring 47*c*. However, the sheet folded in two and dropped downwards by the drop rod apparatus 43 may be caught on the way and may not be dropped to the discharge position of the linking device. In this case, as described in FIGS. 4F to 4H, the pull-in rollers 46*a* and 46*b* of the pull-in apparatus 48 forcibly send the sheet downwards.

The pull-in apparatus 48 is configured with arranging a plurality of the pull-in rollers 46*a* and 46*b* in width direction of the sheet and is disposed on the both sides of the linking device 40, i.e., on the first unit 10 and the second unit 20, respectively. The pull-in apparatus 48 includes a drive shaft 48*a* that rotates the pull-in rollers 46*a* and 46*b*, an actuation arm 48*b* that tilts the pull-in rollers 46*a* and 46*b* such that the sheet is pinched, a support frame 48*c* and a rotation transmitting mechanism 48*d* that rotates the pull-in rollers 46*a* and 46*b*.

The pull-in apparatus 48 is a means that grips the sheet dropped downwards by the drop rod apparatus 43 and pulls the sheet down, and the sheet sent to the linking device can certainly be pulled down and discharged to the outside.

Although the drop rod apparatus 43 and the pull-in apparatus 48 of the above sending mechanism 41 have been described in the example of discharging the sheet stopped and straddling the two carriage paths shown in FIGS. 4A to 7H, the mechanism may be actuated when the sheet exists in one of the two carriage paths as shown in FIGS. 2A to 3C. As a result, the sheet sent to the linking device can certainly be pulled down and discharged to the outside.

Although the sending mechanism 41 has been described in the example of using the visible drop rod apparatus to facilitate the understanding of the features of the present invention, the sheet may be sent to a predetermined direction with the use of blowing air.

Although the first unit and the second unit have been described as the high-capacity external paper feeding apparatus and the image forming apparatus, respectively, to facilitate the understanding of the description of the present invention, the present invention is applicable to such a case that the first unit and the second unit are the image forming apparatus and a bookbinding apparatus, respectively, and the sheet is carried from the image forming apparatus to the bookbinding apparatus.

According to the present invention, regardless of the stop positions of the sheets stopped while being carried, the sheets remaining in the sheet paths can certainly be sent to the linking device linking the two carriage paths and all the sheets can efficiently be collected through the linking device.

The invention claimed is:

1. A paper sheet carrying apparatus having a sheet path of a first unit and a sheet path of a second unit that are linked together by a linking device, wherein the linking device has a drop rod apparatus and a pair of pull-in rollers, and the paper sheet carrying apparatus comprises a control mechanism that discharges a sheet which has been stopped and remained on the way of the sheet paths from the first unit to the second unit in a manner that the remained sheet is dropped between the pair of pull-in rollers by the rod of the drop rod apparatus and pinched by the pair of the pull-in rollers when the remained sheet is sent to the linking device.

2. The paper sheet carrying apparatus as defined in claim 1, wherein when the sheet is located on the sheet path of the second unit, the sheet is reversely carried to be sent to the linking device.

3. The paper sheet carrying apparatus as defined in claim 1, wherein when the sheet straddles the sheet path of the first unit and the sheet path of the second unit, a part of the sheet on the first unit side is carried forward and a part of the sheet on the second unit side is carried backward at the same time whereby the sheet is sent to the linking device.

4. The paper sheet carrying apparatus as defined in claim 1, wherein the linking device includes a sending mechanism for sending the sheet to a predetermined discharge direction.

5. The paper sheet carrying apparatus as defined in claim 1, wherein the linking device includes a collection box for collecting the sent sheet.

6. The paper sheet carrying apparatus as defined in claim 1, wherein the first unit is a paper feeding apparatus and wherein the second unit is an image forming apparatus.

7. The paper sheet carrying apparatus as defined in claim 6, wherein the sheet has not yet arrived in an area of the image forming apparatus where the image is to be transferred to the sheet.

* * * * *